US005945629A

United States Patent [19]

Schildknecht et al.

[11] Patent Number: 5,945,629

[45] Date of Patent: Aug. 31, 1999

[54] FUSELESS BALLISTIC EXPLOSIVE PROJECTILE

[75] Inventors: Manfred Schildknecht, Eckental; Karl Rudolf, Schrobenhausen; Hans Strauss, Reichenschwand, all of Germany

[73] Assignee: Diehl Stiftung & Co., Nuremberg, Germany

[21] Appl. No.: 08/974,989

[22] Filed: Nov. 20, 1997

[30] Foreign Application Priority Data

Dec. 10, 1996 [DE] Germany ..... 196 51 170

[51] Int. Cl.[6] ..... F42B 12/22

[52] U.S. Cl. ..... 102/499; 102/273; 102/473; 102/702

[58] Field of Search ..... 102/204, 205, 102/272, 273, 364, 396, 473, 499, 500, 513, 702, 397

[56] References Cited

U.S. PATENT DOCUMENTS

| | | | |
|---|---|---|---|
| 2,217,645 | 10/1940 | De Wilde et al. . | |
| 2,532,323 | 12/1950 | Miller, Jr. | 102/364 |
| 3,208,385 | 9/1965 | Perniss | 102/364 |
| 3,677,181 | 7/1972 | Giljarhus et al. | 102/364 |
| 4,015,534 | 4/1977 | Engel et al. | 102/513 |
| 4,016,816 | 4/1977 | Larsson et al. | 102/494 |
| 4,348,958 | 9/1982 | Day . | |
| 4,757,765 | 7/1988 | Strandli | 102/499 |
| 5,121,691 | 6/1992 | Nicolas | 102/499 |
| 5,594,197 | 1/1997 | Lundstadt et al. | 102/494 |
| 5,652,408 | 7/1997 | Nicolas | 102/499 |

FOREIGN PATENT DOCUMENTS

| | | |
|---|---|---|
| 0531697 | 3/1993 | European Pat. Off. . |
| 1952494 | 4/1971 | Germany . |
| 2727970 | 1/1978 | Germany . |
| 2423920 | 1/1985 | Germany . |
| 2423921 | 2/1985 | Germany . |
| 3729630 | 3/1989 | Germany . |
| 3210273 | 12/1989 | Germany . |
| 2734779 | 9/1992 | Germany . |
| 4109071 | 8/1996 | Germany . |
| 2192047 | 12/1987 | United Kingdom . |

*Primary Examiner*—Harold J. Tudor
*Attorney, Agent, or Firm*—Scully, Scott, Murphy & Presser

[57] ABSTRACT

A fuse-less ballistic explosive projectile (1) with a great fragmentation effect has a secondary explosive (50) with a special structure (75), the secondary explosive detonating upon impact. The secondary explosive (50) surrounds within a projectile cap (24) a conical projection (30) of a penetration core (18). Transmission of the firing effect from the secondary explosive (50) is effected through a central through bore (40) of the penetration core (18) to a large-volume bursting charge (60) arranged in a projectile body (10).

17 Claims, 4 Drawing Sheets

FUSELESS BALLISTIC EXPLOSIVE PROJECTILE

BACKGROUND OF THE INVENTION

1. Field of the Invention

The invention relates to a fuse-less ballistic explosive projectile which includes a mass arranged in the projectile tip and which detonates upon impact, a bursting charge located in a hollow space within the projectile body, and optionally a tracer portion, wherein the mass is in communication with the bursting charge portion of claim 1.

2. Discussion of the Prior Art

Fuse-less ballistic explosive projectiles which are fired from barrel-type weapons are known. A ballistic projectile for a machine cannon is known from German published specification (DE-AS) No. 1 952 494. It does not have a mechanical fuse. The projectile has two firing charges which are connected one behind the other by a passage. A support disc provided with the passage carries the front firing charge which fires upon impact. That firing charge is in the form of a homogeneous body and is disposed centrally in the projectile cap which is screwed to the projectile body, under the contact pressure of the protective disc. The rear firing charge bears at the bottom against an explosive or bursting charge. By virtue of the two firing charges which burn with a time delay, the bursting charge is set off with a corresponding delay. The volume of the bursting charge is small so that the fragments are generated only from the approximately central part of the projectile body.

U.S. Pat. No. 2,217,645 shows a projectile with a detonating or primer charge arranged in the tip of the projectile, and a bursting charge which can be set off by the detonating charge. Inserted in the detonating charge is a hard body which, upon impact of the projectile, moves as a consequence of its inertia towards the tip of the projectile and fires the detonating charge. A projectile of that kind is intended for weapon calibres of between 6 and 15 mm. When using larger calibres with correspondingly high levels of feed and firing acceleration there is the danger of premature detonation.

A further fuse-less explosive projectile with delayed initiation of the bursting charge is known from DE 24 23 920 C2. A relatively large firing charge is set off by a detonation agent upon projectile impact. The firing charge then fires the explosive charge which is of approximately the same size in terms of volume. In order to reduce the long delay in firing by virtue of the large firing charge, the firing charge has at least one hole in order to increase its burning surface area and thus to reduce its burning time. The fragmentation effect of a projectile of that kind is slight as the bursting charge makes up only about a third of the entire length of the projectile.

A short delay time for initiation of the bursting charge in a fuse-less ballistic explosive projectile in accordance with DE 24 23 921 C1 is achieved by a metal body arranged at the detonation agent side being shot by a propellant charge into a firing charge to produce a hole. The effective length of the part of the firing charge, that still has to be burnt away and which extends approximately from the bottom of the hole to the bursting charge, results in a reduction in the delay time. In this case also the bursting charge is only about a third of the total length of the projectile so that the fragmentation effect of the projectile is relatively slight.

SUMMARY OF THE INVENTION

The object of the present invention is that of providing an explosive projectile without mechanical, electrical, or electronic fuse, with a high level of fragmentation effect. The invention also seeks to provide that the fuse is capable of causing the projectile to detonate in relation to thin targets.

The foregoing object is attained in that the projectile, on the outside of the fragmentation-effective projectile body, includes an impact-sensitive structured secondary explosive as a detonatable mass, the bursting charge constituting the main bursting charge filling the major part of the hollow space within the projectile body, and the structured secondary explosive lies between a projectile cap end the projectile body.

In accordance with the invention a main charge of explosive extends from the base of the projectile or from a tracer portion into the ogive region of the projectile. That ensures that the entire projectile body or virtually the entire projectile body is involved in the fragmentation effect when detonation occurs. An impact-sensitive firing-critical region is associated with the projectile ogive and is therefore disposed outside the projectile body. The central large-volume bore in the projectile body which is otherwise closed at the ogive end guarantees the through-firing effect, starting from a structured secondary explosive to the main charge. The bore diameter is so selected that firing of the main charge is guaranteed.

The structured secondary explosive has a plurality of uniformly distributed, small hollow spaces or cavities. That increases the shock sensitivity of the secondary explosive. Upon impact the hollow spaces or cavities collapse and produce high local pressure peaks which lead to initiation of the structured secondary explosive.

The specifically structured secondary explosive guarantees firing sensitivity with the given impact energies at the target, in particular when dealing with thin targets. The projectile therefore involves detonative firing by commercially available secondary explosive, by way of a specific geometrical structuring. There is also no need for a mechanical fuse unit such as a fuse striker and rotor or slider by virtue of the use of primary explosive. The detonation agent used as the specifically structured secondary explosive therefore affords a crucial cost advantage. There is also no need for a protection device which is required by the relevant provisions.

The hollow spaces are regularly shaped. They are in the shape of a ball, a cylinder or an ellipsoid.

A piercing or penetration core at the ogive end increases the fragmentation action of the projectile, particularly in relation to lightly armoured vehicles or aircraft structures.

Conversion of the impact energy of the projectile at a target is guaranteed in all angular ranges, that is to say both upon direct impact and also in the event of very shallow impact, by virtue of the structured secondary explosive which is between the projectile cap and the penetration core. The penetration core acts as an anvil for the secondary explosive which is deformed upon impact by the cap. The anvil increases the firing action by reflection of the shock waves generated upon impact in the explosive.

The cap is fixed in a simple manner to the penetration core either by a screwthreaded connection or by a positively locking, releasable connection.

BRIEF DESCRIPTION OF THE DRAWINGS

Embodiments of the invention are illustrated in the drawing in which.

DETAILED DESCRIPTION OF PREFERRED EMBODIMENTS

Figure 1:
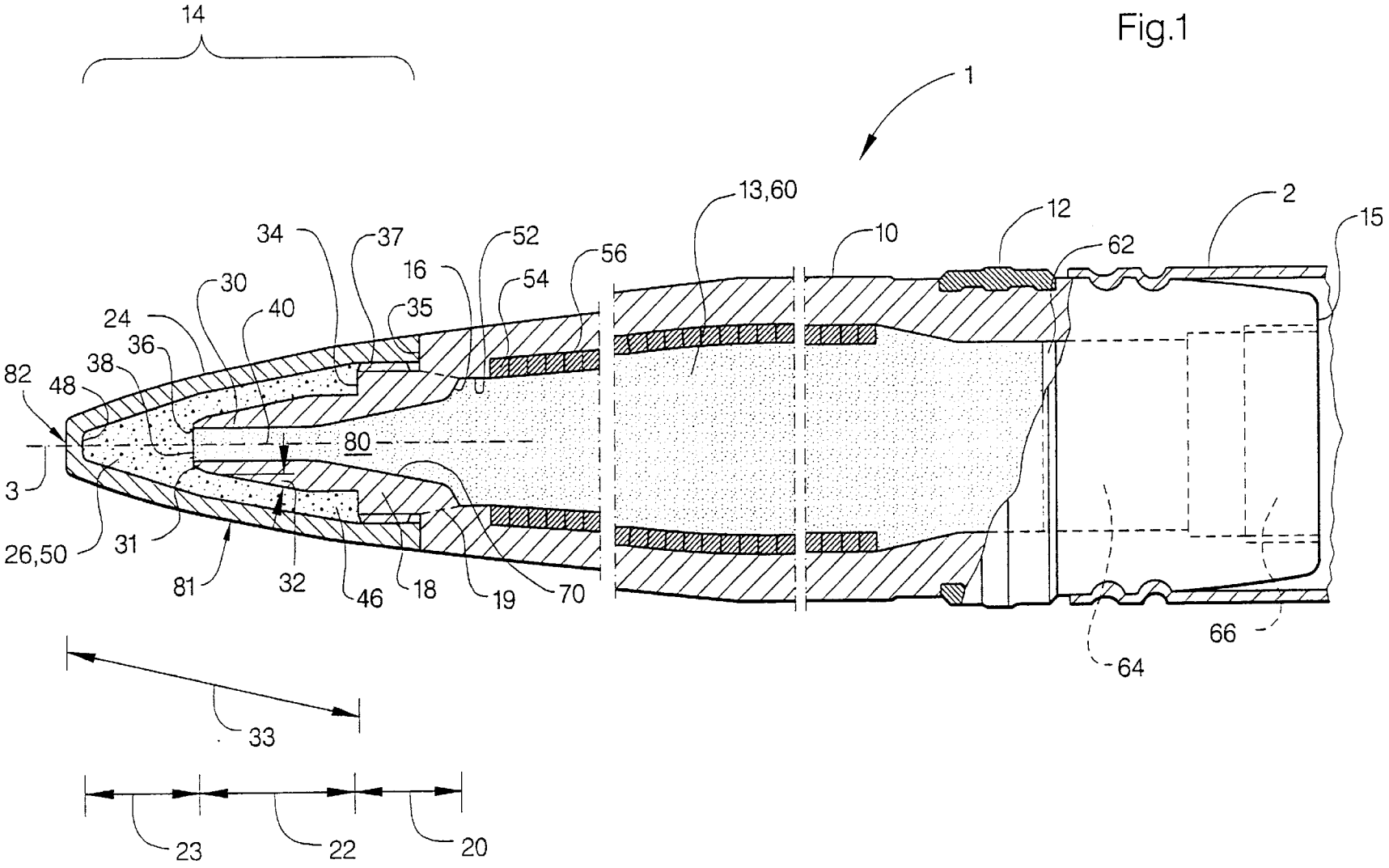
FIG. 1 is a partly sectional view of a projectile with a propellant charge casing.

The projectile 1 provided with a propellant charge casing portion 2 comprises a projectile body 10 which on its periphery has a guide and sealing ring 12 and in its interior a hollow space 13 which extends from the base 15 into the region of the projectile ogive 14. The hollow space 13 terminates with a bore cone 16 at a penetration core 18 which is integrally connected to the projectile body 10.

The penetration core 18 is divided into two portions 20, 22. A first portion 20 at the side towards the projectile body serves for fixing a thin-gauge projectile cap 24 of aluminium by way of a screwthreaded connection 37. In that arrangement the projectile cap 24 bears against a step 35 on the projectile body 10.

A second portion 22 of the penetration core 18 comprises a projection 30. The projection 30 is of a primarily conical configuration with a taper angle 32 of 10°. The projection 30 forms a step 34 in relation to the portion 20. In the region 22 the projectile cap 24 also involves the taper angle 32 of 10° and therefore with the projection 30 forms a region 33 which is suitable for shallow angles of incidence and which is critical in terms of detonation.

At the end the projection 30 has an annular end surface 31 which is disposed at a right angle to the main axis 3 of the projectile 1.

A central bore 40 opens both into the end surface 31 and also into the bore cone 16. The main charge which is referred to as the bursting charge 60 fills the hollow space 13 and the bore 40 as far as the end surface 31. The charge portion which extends over the portions 20, 22 is referred to as the transmission charge 80. At the end the bore 40 has a small entry funnel portion 38 formed by a radius 36 while at its exit end it has a trumpet-shaped outlet funnel portion 70. The outlet funnel portion 70 begins approximately at a position corresponding to half the length of the penetration core 18 and is substantially larger than the entry funnel portion 38.

Figure 3:
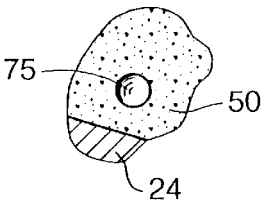
Figure 4:
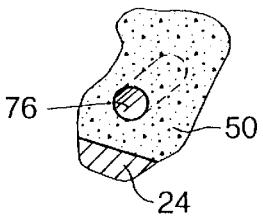
Figure 5:
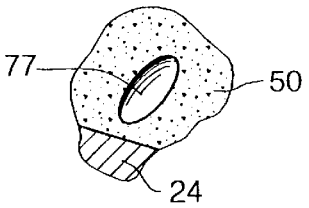

The end surface 31 is disposed at a spacing 23 in relation to an end wall 48 of the cap 24. Both the cup-shaped hollow space 26 formed thereby, to and including the annular space 46, are filled with a commercially available but structured secondary explosive 50. The secondary explosive 50 has a plurality of small hollow spaces of spherical shape 75 uniformly distributed over the entire secondary explosive, see FIG. 3. Cylinders 76 as shown in FIG. 4 or ellipsoids 77 as shown in FIG. 5 may also be used as further shapes for the hollow spaces. The above-mentioned shapes 75–77 may also be arranged mixedly in the secondary explosive 50.

The annular cross-sections of the annular space 46 are so large that—starting from local firing-detonation of the structured explosive is not stopped but propagates in all directions.

Provided near the penetration core 18 in an inside wall 52 of the penetration core 18, corresponding to the radial thickness of a fragmentation casing 56, is a step 54 for supporting the latter.

The fragmentation casing 56 comprises conventional prefabricated fragments such as cubes or the like.

The fragmentation casing 56 extends to a position in the proximity of the region of the guide ring 12.

The bursting charge 60 fills the hollow space 13 and also bears against the fragmentation casing 56.

The bursting charge 60 is supported at its base relative to a tracer portion 64 by a disc 62 of foam. The tracer portion 64 is in turn fixed in the projectile body 10 by an apertured disc 66.

In the event of frontal impact of the projectile 1 on to a target (not shown) the projectile cap 24 and therewith the secondary explosive 50 in the front region are compressed in accordance with the spacing 23 against the end surface 31 of the penetration core 18. The hollow spaces of the secondary explosive 50 collapse and produce high local pressure peaks which result in initiation of the entire secondary explosive 50. Detonation of the secondary explosive 50 bursts the projectile cap 24 and fires at the entry funnel portion 38 the transmission charge 80 and therewith subsequently the main charge 60. Detonation of the bursting charge 60 causes fragmentation of the projectile body 10 with acceleration of the individual fragments of the fragmentation charge 56 and fragmentational destruction of the projectile body 10. At the same time the penetration core 18 is separated off at the cross-section identified by reference numeral 19, as a fragment of large mass.

The desired time-delayed firing of the bursting charge 60 is ensured by the travel distances of the shock waves in the charges 50, 80. In the event of lateral target impact as indicated by the arrow 81 the projectile involves a greater time delay than in the event of a frontal impact as indicated by the arrow 82, by virtue of the deflection effect at the entry funnel portion 38.

In order further to increase the fragmentation effect the bursting charge 60 can be enlarged by the bursting charge 60 extending as far as the apertured disc 66, in which case then the latter would have to be in the form of a solid disc. The tracer portion 64 is then omitted.

In the event of lateral impact of the projectile 1 against a target at an angle of about 10°, then, as described above, the rear region 33 which is critical in terms of detonation causes firing of the secondary explosive 50 in the annular hollow space 46. Compression of the secondary explosive 50 in the hollow space 46 occurs due to deformation of the projectile cap 24, with the secondary explosive 30 being pressed against the strong projection 30. The bursting charge 60 is then detonated in the above-described manner.

Figure 2:
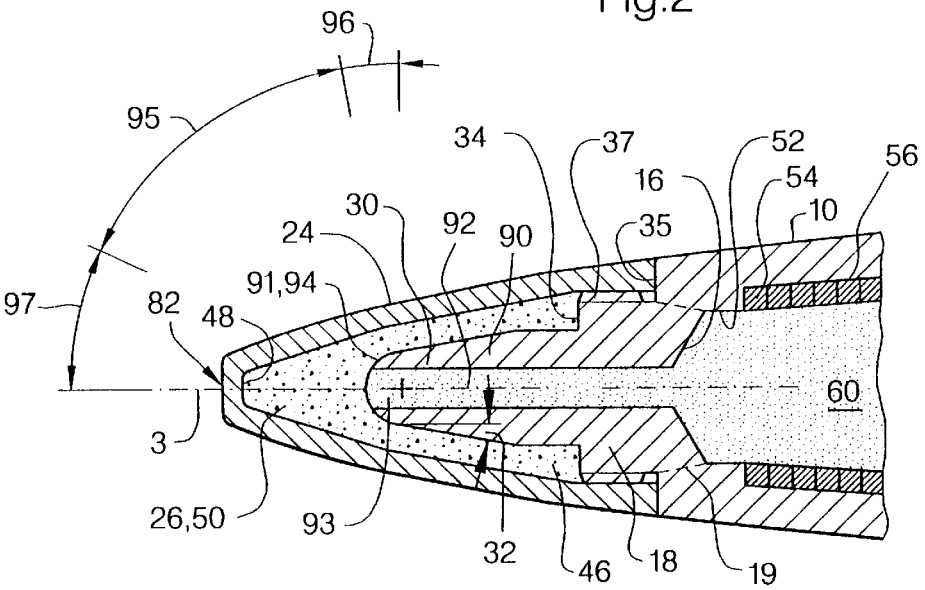
FIG. 2 is a view in longitudinal section through a penetration core in an alternative configuration to FIG. 1, FIGS. 3–5 are views on an enlarged scale of detonation agents for the projectile shown in FIG. 1, FIGS. 6 and 7 show fuse variants for the projectile shown in FIG. 1.

Referring to FIG. 2, the arrangement shown therein has a conical projection 90 with a spherical portion 91 at its end and with a central cylindrical bore 92. A transmission charge 93 which is integral with the main charge 60 fills the bore 92.

The surface 94 acting as the anvil is enlarged in comparison with the construction shown in FIG. 1. That surface 94 extends over an impact region 95 of 55° between an impact angle 96 of 10° and an impact angle 97 of 25°. That large surface 94 improves the detonation sensitivity of the secondary explosive 50.

The detonation sensitivity of the projectile 1 in relation to shallow angles of incidence may also be further increased by the conical projection 30, 90 having a suitable surface structure on its periphery. That surface structure can be ribbed, knobbed or of some other suitable configuration.

The transmission charges 80, 93 can be omitted in favour of free bores 40, 92 or they can be replaced by other suitable bursting charges or also layered charges.

The main charge 60 is a commercially available explosive.

Figure 6:
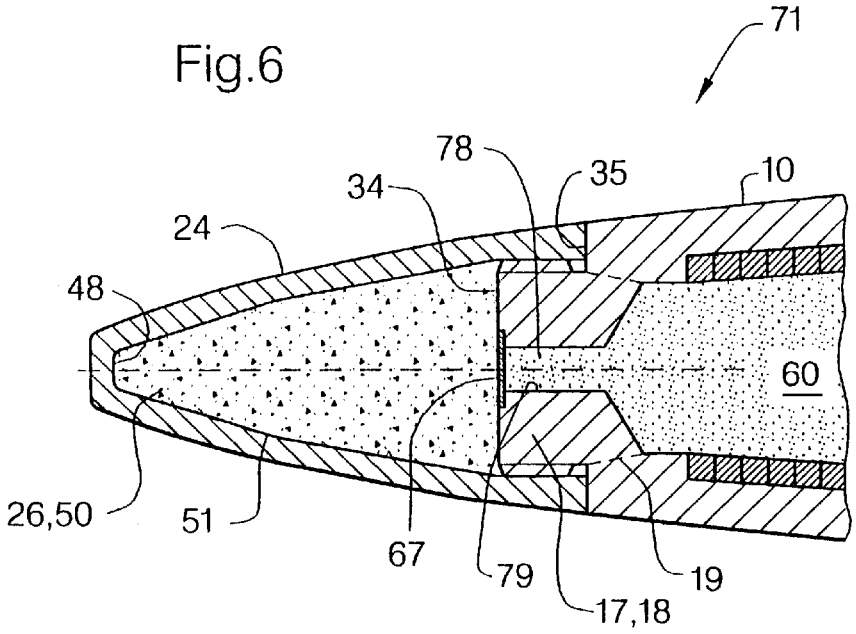

In the case of a projectile 71 as shown in FIG. 6 the structured secondary explosive 50 fills the entire hollow space 26 between the base 48 and the step 34 of the penetration core 18. Disposed between the transmission charge 78 in the bore 79 of the transmission core 18 and the structured secondary explosive 50 is a metal plate 67 which is held in the penetration core 18. The penetration core 18 is in the form of a short single-stage cylinder 17. A part of the main bursting charge 60 forms the transmission charge 78.

Figure 7:
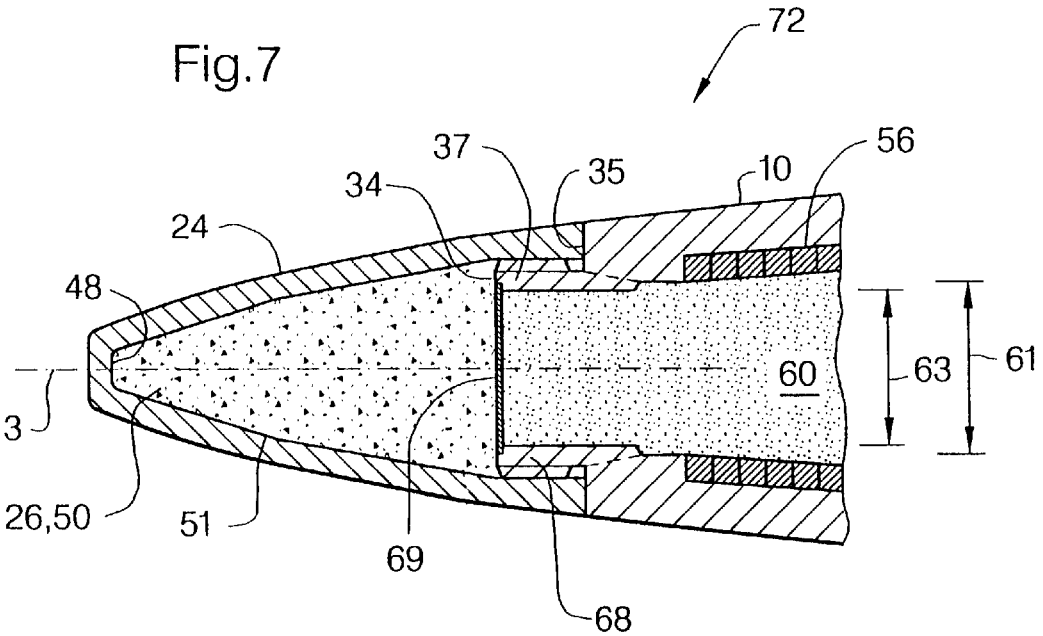

A projectile 72 as shown in FIG. 7, in comparison with the construction shown in FIG. 6, does not have the bore 85 for the transmission charge 80, insofar as a tubular flange 68 of a diameter which almost corresponds to the diameter 61 of the main bursting charge 60 is provided on the projectile body 10 at the end thereof. The division between the main bursting charge 60 and the structured secondary explosive 50 is effected by means of a metal plate 69 which bears against the tubular flange 68.

In the embodiments shown in FIGS. 6 and 7 the structured secondary explosive 50 is approximately in the form of a truncated cone 51.

A crucial consideration in regard to the projectile 71, 72 as shown in FIGS. 6 and 7 is that upon target impact, a sufficiently large shock wave is passed by way of the projectile cap 24 into the structured secondary explosive 50. As a result the cavities or hollow spaces in the structured secondary explosive 50 collapse and produce high local pressure peaks which result in the through-firing effect of the structured secondary explosive 50. In that case the metal plate 67, 69 is destroyed with subsequent initiation of the main charge 60 by way of the transmission charge 78 in the bore 79 or directly as shown in FIG. 7.

Figure 8:
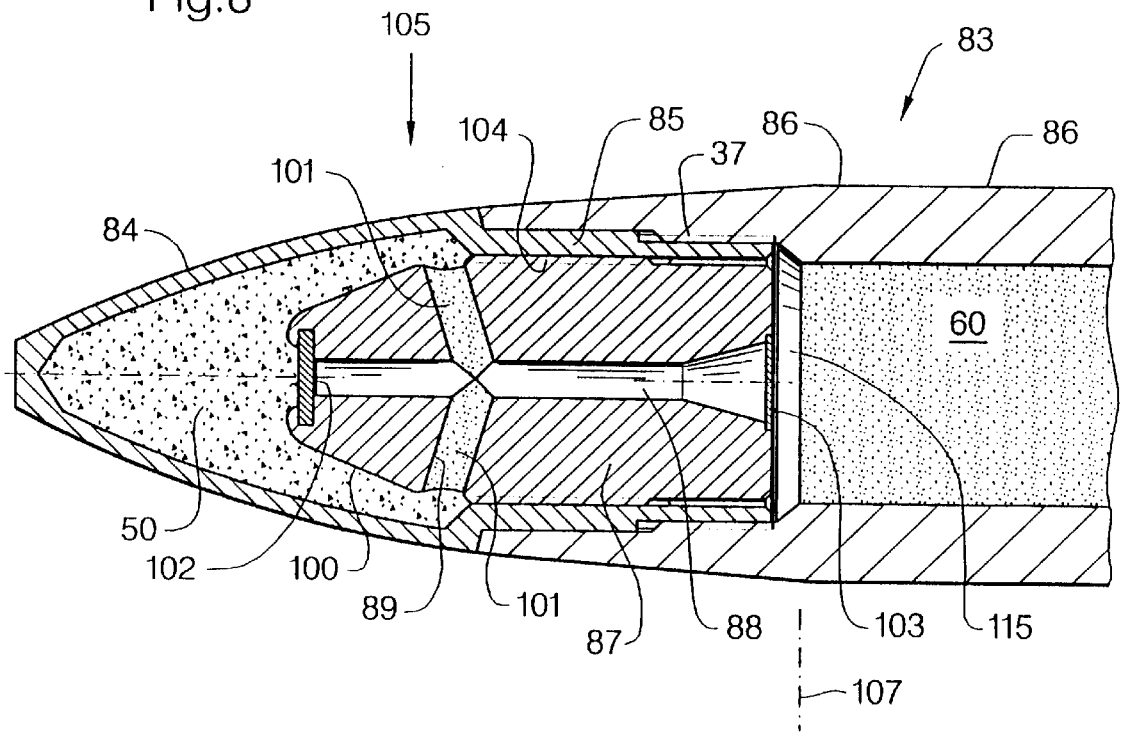
FIG. 8 shows a 20 mm projectile with a further fuse variant.

Referring to FIG. 8, in a projectile 83 a projectile cap 84 is prolonged by a reduced-diameter casing portion 85. The screwthreaded connection 37 is provided between the casing portion 85 and a projectile body 86. A body 87 is mounted by way of a screwthreaded connection 104 in the casing portion 85. The body 87 has a central bore 88 and passages 89 which are radial in relation thereto. A conventional explosive 101 is disposed in the passages 89.

The structured secondary explosive 50 is disposed between the projectile cap 84 and a cone portion 100 of the body 87. Metal plates 102, 103 close the bore 88 at the ends.

Figure 9:
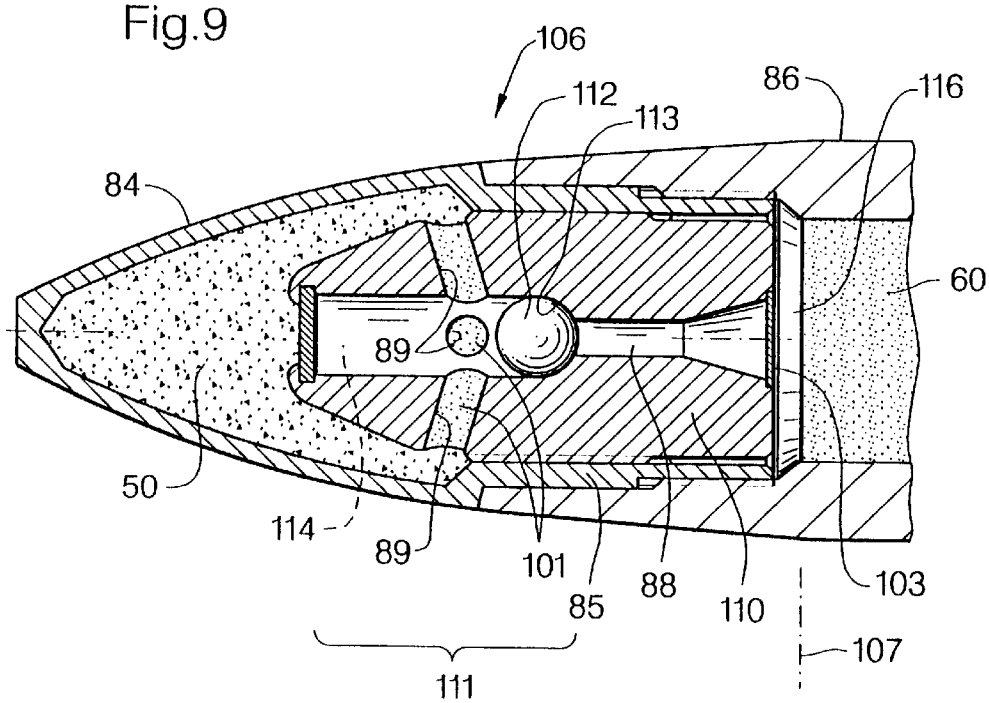
FIG. 9 shows a pre-bore and bore-safe safety arrangement in an explosive projectile.

The projectile cap 84 forms with the body 87 a pyrotechnic fuse 105. That fuse 105 is in the form of a self-contained structural unit which can be screwed into place and which can thus be universally employed. It can be exchanged for conventional fuses such as mechanical, electrical or electronic fuses, subject to an interface 107 which is appropriate in terms of the explosive involved. The same applies for a fuse 106 as shown in FIG. 9. In addition to the components already described, in a body 110, it has a pre-bore and bore-safe safety arrangement 110 in the form of a ball safety assembly 112 with valve seat 113 and a front armed position 114 for the ball safety assembly 112.

A hollow space between the projectile fuse 105, 106 and the main charge 60 is identified by reference 115. In place of that hollow space 115, it is also possible to provide a disc 116 made of a strong foam which can be destroyed at the explosive side.

The functions of the fuses 105, 106 correspond in principle to the function described in relation to the projectile 1. In addition the fuse 106 has the pre-bore and bore-safe safety arrangement by virtue of the detonation passages 89 which are displaced forwardly to the valve seat 113. The main charge 60 therefore remains safe in the weapon barrel and up to about 2.5 m after leaving the muzzle of the barrel.

We claim:

1. A fuse-less ballistic explosive projectile (1) comprising a projectile body having a fragmentation casing (56) including a plurality of fragments along an inner surface of said projectile body for producing a fragmentation effect, said projectile further comprising an impact-sensitive structured secondary explosive mass (50) which is arranged in in a projectile tip and which detonates upon impact against a target, a bursting charge (60) being arranged in a hollow space (13) in the projectile body, and the secondary explosive mass (50) being in communication with the bursting charge (60), the projectile (1) having the impact-sensitive structured secondary explosive mass (50) located forwardly of the projectile body, the bursting charge forming the main bursting charge (60) which fills the major part of a hollow space (13) within the projectile body, the structured secondary explosive mass (50) lies between a projectile cap (24) and the projectile body, the cap located only in a forward portion of the projectile and a penetration core (18) having a projection (30) of predetermined configuration extending forwardly of said projection body secondary into said structured explosive mass (50) to form a primer anvil against the secondary explosive mass (50), an annular portion of said secondary explosive mass extending about said projection and a forward portion of said secondary explosive mass filling an interior of said projectile cap, upon deformation of the projectile tip (82) when impacting a target so as to intensify a triggering effect on the secondary explosive mass through reflection of shockwaves in the secondary explosive mass which are generated during the impact.

2. An explosive projectile according to claim 1 characterised in that the structured secondary explosive mass (50) has small, regularly shaped cavities (75–77), and the cavities (75–77) are of selectively a spherical, cylindrical or ellipsoidal configuration.

3. An explosive projectile according to claim 1 characterised in that at the tip end the projectile body has the penetration core (18) include a central through bore (40) and said bore (40) contains the explosive of the main bursting charge (60).

4. An explosive projectile according to claim 3 characterised in that the penetration core (18) is divided into two portions (20, 22) of which, a first portion (20) at the projectile body side serves to secure the projectile cap, a second portion (22) has an annular cavity (46) for receiving the structured secondary explosive mass (50) and the cross-sections of said cavity (46) and the through bore (40, 92, 85) ensure through-firing of the structured secondary explosive mass (50) and the explosive of the main bursting charge (60).

5. An explosive projectile according to claim 4 characterised in that the penetration core (18) is in respect of its second portion (22) predominantly in the form of a conical projection (30) with a taper angle (32) of about 10°, wherein the projection (30) with the first portion (20) forms a step (34).

6. An explosive projectile according to claim 4 characterised in that the projectile cap bears against a step (35) on the projectile body.

7. An explosive projectile according to claim 1 characterised in that the penetration core (18) surrounded by the projectile cap is enclosed in a hollow cup shape by the structured secondary explosive mass (50) which detonates upon impact.

8. An explosive projectile according to claim 4 characterised in that between the conical projection (30) and the end wall (48) of the cap there is a spacing (23) which is also filled with the structured secondary explosive mass (50).

9. An explosive projectile according to claim 5 characterised in that at the end the projection (30) has an annular end surface (31) which is disposed at a right angle to the main axis (3) of the projectile (1).

10. An explosive projectile according to one of the claim 4 characterised in that the taper angle (32) of the conical projection (30) approximately corresponds to the conicity of the projectile cap.

11. An explosive projectile according to claim 3 characterised in that the through bore (40) centrally passes through both the projection (30) and also the penetration core (18) and thus connects a hollow space (26) for the structured secondary explosived mass (50) to the hollow space (13) for the bursting charge (60).

12. An explosive projectile according to claim 1 characterised in that the hollow space (13) of the projectile (1) has near the penetration core (18) at the periphery a step (54) against which said fragmentation casing (56) bears at its end, the fragmentation casing extensively lining the hollow space (13) at its periphery.

13. An explosive projectile according to claim 3 characterised in that the penetration core (18) has at its end a spherical portion (91) through which a central bore (92) passes.

14. An explosive projectile according to claim 3 characterised in that a front end the central bore (40) has an entry funnel portion (38) and at its exit end either it has a substantially larger outlet funnel portion (70) or a cylindrical bore (92) is selectively cylindrical.

15. An explosive projectile according to claim 1 characterised in that the projectile body has a tubular flange being provided with a screwthread connection (37).

16. An explosive projectile according to claim 1 characterised in that the projectile cap is prolonged by a reduced-diameter casing portion (85), a screwthreaded connection (37) is between the casing portion (85) and the projectile body, a body (87, 110) is mounted in the casing portion (85) by a releasable fixing means (104), and the body (87, 110) has at least one bore (88) for firing transmission.

17. An explosive projectile according to claim 16 characterised in that a pre-bore and a bore-safe safety arrangement (111) in the form of a ball safety assembly (112) is arranged with the body (110).

* * * * *

UNITED STATES PATENT AND TRADEMARK OFFICE

CERTIFICATE OF CORRECTION

PATENT NO. : 5,945,629
DATED : August 31, 1999
INVENTOR(S) : M. Schildknecher, et al.

It is certified that error appears in the above-identified patent and that said Letters Patent is hereby corrected as shown below:

Column 6, claim 1,
Line 12, delete second instance of -- in --

Column 7, claim10,
Line 17, "to one of the claim 4" should read -- to claim 4 --

Column 8, claim 14,
Line 9, "that a front" should read -- that at a front --
Line 10, "either if has" should read -- it has either --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*